US009542822B2

(12) United States Patent
Zur et al.

(10) Patent No.: US 9,542,822 B2
(45) Date of Patent: Jan. 10, 2017

(54) METHOD TO ACTIVATE SMART PHONE ALARM ON ATTEMPT TO OPEN DOOR OR WINDOWS

(71) Applicants: Nissim Zur, Givataim (IL); Eli Arad, Tzofit (IL)

(72) Inventors: Nissim Zur, Givataim (IL); Eli Arad, Tzofit (IL)

(73) Assignees: Eli Arad, Tzofit (IL); Nissim Zur, Givatayim (IL)

( * ) Notice: Subject to any disclaimer, the term of this patent is extended or adjusted under 35 U.S.C. 154(b) by 0 days.

(21) Appl. No.: 14/616,707

(22) Filed: Feb. 8, 2015

(65) Prior Publication Data

US 2015/0287298 A1 Oct. 8, 2015

Related U.S. Application Data

(60) Provisional application No. 61/940,432, filed on Feb. 16, 2014.

(51) Int. Cl.

| | |
|---|---|
| ***G08B 13/08*** | (2006.01) |
| *G08B 13/19* | (2006.01) |
| *G08B 25/08* | (2006.01) |

(52) U.S. Cl.

CPC ..... *G08B 13/08* (2013.01); *G08B 13/19* (2013.01); *G08B 25/08* (2013.01)

(58) Field of Classification Search

CPC ..... G08B 13/08; G08B 13/04
USPC ..... 340/545.1, 506, 541, 545.9, 565, 572.1
See application file for complete search history.

(56) References Cited

U.S. PATENT DOCUMENTS

| | | | | |
|---|---|---|---|---|
| 6,989,746 | B2 * | 1/2006 | Rasmussen | G08B 13/04 116/86 |
| 9,183,712 | B2 * | 11/2015 | Witmer | G08B 13/00 |
| 2011/0054830 | A1 * | 3/2011 | Logan | G06F 3/011 702/141 |
| 2013/0057404 | A1 * | 3/2013 | Thibault | G08B 29/22 340/545.1 |
| 2013/0057405 | A1 * | 3/2013 | Seelman | G08B 29/185 340/545.2 |
| 2013/0087608 | A1 * | 4/2013 | Addy | G06F 17/30879 235/375 |
| 2014/0085088 | A1 * | 3/2014 | Graphenius | G08B 21/0415 340/545.2 |

* cited by examiner

*Primary Examiner* — Phung Nguyen
(74) *Attorney, Agent, or Firm* — Reches Patents

(57) ABSTRACT

An alarm system may be provided and may include a miniature coin size tag attached to doors and windows. The tag has electronic 3 axial accelerometer with wireless notification system to user's smart phone.

20 Claims, 17 Drawing Sheets

Determining at least one jiggling value that represents differences between acceleration values that (a) are obtained during the certain period and (b) are associated with at least one axis of the three axes. Each jiggling value may represent a maximal difference between acceleration values associated with a certain axis of the three axes. 711

Providing an outcome of the auto learning algorithm that may include the jiggling threshold. 712

Monitoring, by a real time clock mechanism of the tag, a time of occurrence of events. 713

710

720

Applying the auto-learning algorithm to detect acceleration values that deviate from an allowable acceleration pattern. The allowable acceleration pattern may include an allowable change of acceleration values over time. 721

Rejecting acceleration values indicative of a jiggling of the object due to weather and to trigger the alert in response to acceleration values that are indicative of an opening of the object. 722

Triggering the alert when sensing that at least a portion of the object has undergone a free fall. 723

Triggering the alert also in response to temperature readings from the temperature sensor. 724

Determining whether to trigger the alert in response to the information about the ambient temperature. 725

Generating the alert if a jiggling value of the at least one jiggling values exceeds a jiggling threshold. 726

Preventing a triggering of the alert when sensing that a mobile device that is paired to the tag is in proximity of the tag. 727

Triggering a buzzer of the tag to output an audio alert. 728

730

Triggering a provision of power to the transmitter in response to the acceleration values that were obtained at a certain period and in response to the outcome of the auto learning algorithm. 731

Stopping the provision of the power to the transmitter after at least one out of (a) a lapse of a predefined period after the triggering of the provision of the power, and (b) a completion of a transmission, by the transmitter, of an alert signal to a mobile device paired with the tag. 732

740

Transmitting information about the acceleration values obtained during the certain period. 741

Generating an audio and/or visual alarm by the tag. 742

FIG. 16

METHOD TO ACTIVATE SMART PHONE ALARM ON ATTEMPT TO OPEN DOOR OR WINDOWS

RELATED APPLICATIONS

This application claims priority from U.S. provisional patent Ser. No. 61/940,432 filing data Feb. 16, 2014.

FIELD OF THE INVENTION

The present invention is in the field of alarm systems for buildings. And more particularly to a system for monitoring doors and windows jiggling movement and wirelessly report to all smart phones in range.

BACKGROUND OF THE INVENTION

Lots of home residence lack the securely alarm system they need just because the cost of alarm system to cover all doors and windows is too high. It is so due the need of transfer wires between all windows and doors to a central control box. No one likes to dig the walls and place the alarm system wires. In most cases it is not practical or not allowed by landlords. Also wireless alarm sensors are too expensive and need a professional installing.

Moreover, many of the alarm security devices are connected to central control box. That central box connects to Security Company under monthly retainer fee.

There is a need for low cost alarm system, self-installing, no monthly retainer fee, no central control box, no wires, no need for power supply connect to sensors. The common need is for a very simple low cost, a coin size wireless tag that can be attached in 10 seconds to any windows or doors, automatically connect to all residents smart phone.

The problem of protecting homes, businesses and other premises against unauthorized intrusions is becoming increasingly important due to the increase in vandalism, theft and even physical attacks upon the inhabitants. Various prior art systems have been developed to address the problem and numerous examples exist of alarm or warning devices. Commonly used protective system involves wiring and wireless doors and windows in such a manner that an unauthorized opening of the door or window activates an electric circuit which in turn produces an alarm.

While there are inventions in the prior art alarm systems utilizing fix trigger level detection, none are known to the inventor which auto learning capabilities encapsulate several factors as accelerometer jiggle history. The user definitions jiggle level on its smart phone apps, time and date to activate, external weather situation like extreme wind or rain from the internet and proximity to the user smart phone.

The lack of auto learning capabilities and calibration from the smart phone apps and the link to weather information from internet source will produce many false alarms by vibration of windows or doors due to outside wind and rain.

For example, U.S. Pat. No. 8,217,790 B2 to Michael H. Script, A portable security alarm system including a movement detecting and signal transmitting member for mounting on or proximate to the object whose movement is to be detected, a signal receiving and alarm generating member for receiving a signal from the movement detecting and signal transmitting member and producing a security response.

While effective, this system present a fix detection level and not auto learning capabilities, moreover the lack of the smart phone apps and to weather from internet source will produce many false alarms due vibration of windows or doors due to outside wind.

For example, U.S. Pat. No. 4,271,405 to Kitterman discloses an alarm control system for protecting a premises including a four conductor bus line leading from a master control station and extending about the interior perimeter of the premises. Sensors positioned near each port of entry to be monitored are connected in parallel relationship to the bus line. Each sensor carries a biased reel carrying line secured to a window, door, screen or the like. Disturbance of a sensor causes a magnetically responsive switch therein to generate a pulse triggering circuitry within the control station to activate the desired alarm device.

While effective, this system requires extensive wiring of the premises as a bus line must be routed about the interior perimeter of the premises between a master control station and the ports of entry at which the motion sensors are to be located. Hence, this system is time consuming and complicated to install, and installation may require expertise beyond that of the average home or business owner. Once installed, the sensors of this system are not easily relocated. Further, the system may be defeated by cutting the wires extending between the sensors and the master control station.

U.S. Pat. No. 3,781,836 to Kruper et al discloses an alarm system including a magnetic pulse generator for producing an output pulse in response to a change in magnetic flux in response to an intrusion of a designated area. A radio transmitter circuit responds to the pulse from the magnetic pulse generator by transmitting a signal to a remote receiver circuit which in turn generates a pulse for actuating an intrusion alarm circuit. The system requires a complex linkage assembly to translate motion of the object to motion of a magnet. In addition a relatively bulky pick-up coil assembly is necessary to generate the pulse to be applied to the transmitter circuit.

U.S. Pat. No. 3,696,380 to Murphy discloses a portable alarm device with a battery or low voltage operated sound signal triggered by a magnetic reed switch which is closed to complete the circuit by a magnet attached to a movably mounted arm, the poles of the magnet being positioned perpendicular to the longitudinal dimension of the contact strips of the reed switch to cause the reed switch to close when the magnet is in either of two positions relative to the switch.

A need remains for a motion detection and signal generating system which is small in size, easily transportable, easy to install and which can sense motion relative to any desired initial position of an object. An additional desirable capability of the foregoing system would be to provide information about the detected motion to the owner of the object, or a remote location such as law enforcement or other security agency. It would likewise be desirable to provide identification information about a specific object whose motion has been detected in the event that the motion detection and signal generating system is implemented to detect motion at multiple locations (e.g., doors, windows) within a larger security area (e.g., a residence, an office or otherwise).

SUMMARY

According to an embodiment of the invention there may be provided a tag that may include a three axial accelerometer, a controller, a transmitter and an attachment member for attaching the tag to an object; wherein the three axial accelerometer may be configured to monitor accelerations of the object along three axes and generate acceleration values; wherein the controller may be configured trigger an alert in response to (a) acceleration values obtained at a certain period and (b) an outcome of an auto learning algorithm applied on, at least, historical acceleration values obtained during a learning period that started before the certain period.

The controller may be configured to apply the auto-learning algorithm to detect acceleration values that deviate from an allowable acceleration pattern.

The allowable acceleration pattern may include an allowable change of acceleration values over time.

The controller may be configured to reject acceleration values indicative of a jiggling of the object due to weather and to trigger the alert in response to acceleration values that are indicative of an opening of the object.

The controller may be configured to trigger the alert when sensing that at least a portion of the object has undergone a free fall.

The tag further may include a temperature sensor; wherein the controller may be configured trigger the alert also in response to temperature readings from the temperature sensor.

The controller may be configured to receive information about ambient temperature and wherein the controller may be configured to determine whether to trigger the alert in response to the information about the ambient temperature.

The controller may be configured to trigger a provision of power to the transmitter in response to the acceleration values that were obtained at a certain period and in response to the outcome of the auto learning algorithm.

The controller may be configured to stop the provision of the power to the transmitter after at least one out of (a) a lapse of a predefined period after the triggering of the provision of the power, and (b) a completion of a transmission, by the transmitter, of an alert signal to a mobile device paired with the tag.

The controller may be configured to determine at least one jiggling value that represents differences between acceleration values that (a) are obtained during the certain period and (b) are associated with at least one axis of the three axes.

The tag wherein each jiggling value represents a maximal difference between acceleration values associated with a certain axis of the three axes.

The controller may be configured to generate the alert if a jiggling value of the at least one jiggling values exceeds a jiggling threshold.

The tag may be configured to receive the jiggling threshold.

The outcome of the auto learning algorithm may include the jiggling threshold.

The controller may be configured to prevent a triggering of the alert when sensing that a mobile device that is paired to the tag is in proximity of the tag.

The tag may include a bar code, QR code, or other graphical code, that facilitates a downloading, by a computerized device, of an application that once executed by the computerized device causes the computerized device to communicate with the tag and to respond to the alert.

The tag may include a buzzer; wherein the controller may be configured to trigger the buzzer to output an audio alert.

The tag may include a real time clock mechanism, wherein the tag may be configured to monitor a time of occurrence of events.

The transmitter may be configured to transmit, in response to a triggering of the alarm, information about the acceleration values obtained during the certain period.

The information about the acceleration values may include at least one jiggling value that represents differences between acceleration values that (a) are obtained during the certain period and (b) are associated with at least one axis of the three axes.

The tag may include a receiver, wherein the receiver may be configured to receive an alert signal from another, and wherein the tag may be configured to relay the alert signal.

According to an embodiment of the invention there may be provided a mobile device that may include a wireless transceiver, a contact screen and a processor; wherein the wireless transceiver may be configured to receive, from a tag, information about the acceleration values obtained during a certain period and an alert signal; wherein the processor may be configured to process the information to determine whether to generate a mobile device alert; and wherein the contact screen may be configured to generate a mobile device alert when it is determined to generate the mobile device alert.

The processor may be configured to process the information to provide a visual representation of the information; and display to a user the visual representation of the information; wherein the mobile device may be configured to transmit to the tag at least one configuration command for configuring the tag.

The information about the acceleration values may include at least one jiggling value that represents differences between acceleration values that (a) are obtained during the certain period and (b) are associated with at least one axis of three axes that are oriented to each other.

The processor may be configured to determine whether to generate the mobile device alert in response to information about weather at a vicinity of the tag.

According to an embodiment of the invention there may be provided a method that may include attaching a tag to an object; monitoring, by a three axial accelerometer of the tag, accelerations of the object along three axes and generating acceleration values; triggering, by a controller of the tag, an alert in response to (a) acceleration values obtained at a certain period and (b) an outcome of an auto learning algorithm applied on, at least, historical acceleration values obtained during a learning period that started before the certain period.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIG. 16 illustrates a method according to one embodiment of the present invention.

DETAILED DESCRIPTION OF THE INVENTION

Figure 1:
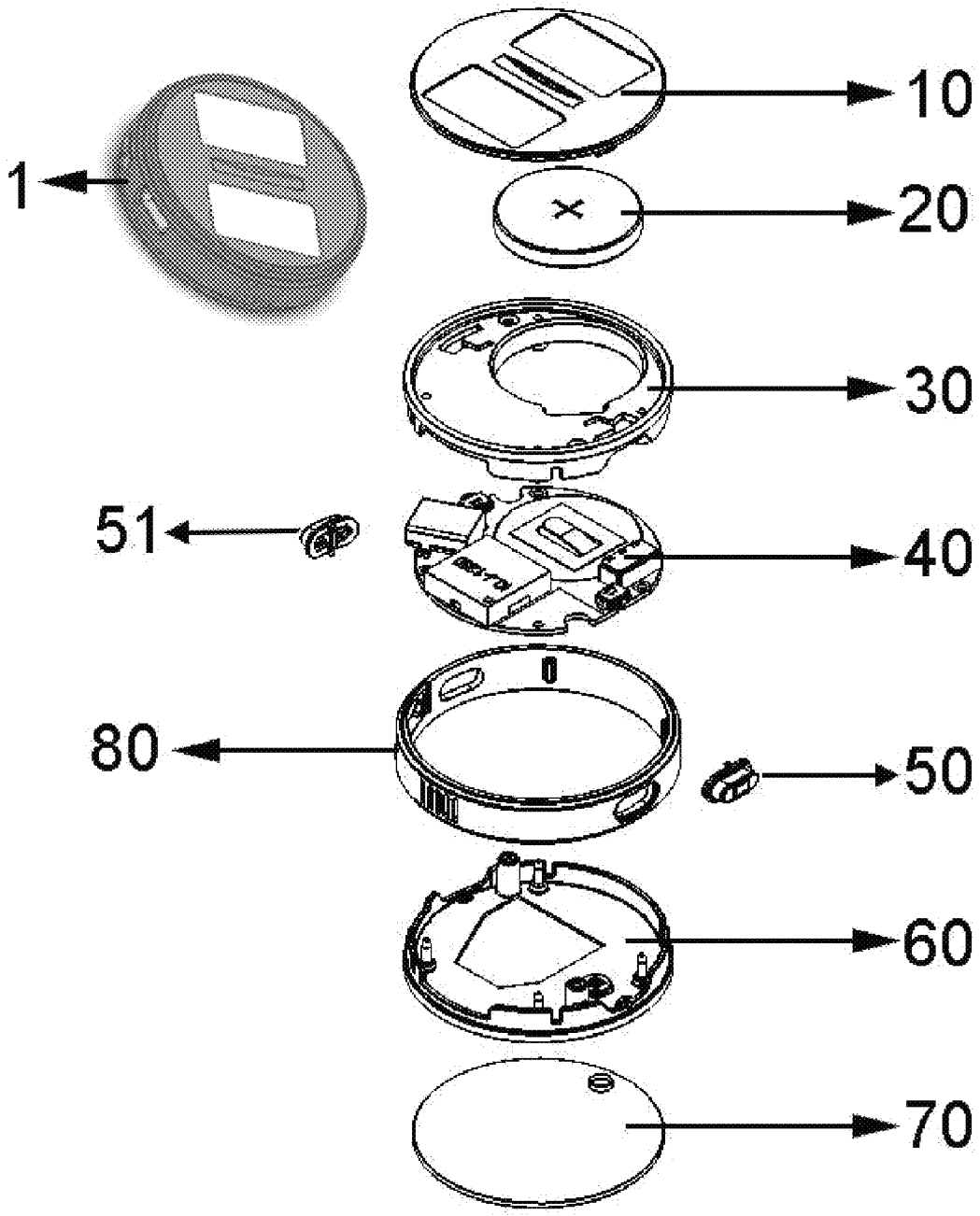
FIG. 1 is the tag explode view, pictorial diagram showing the components of a jiggle alarm tag according to one embodiment of the present invention as they appear inside the tag.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference in the specification to a method should be applied mutatis mutandis to a system capable of executing the method.

Any reference in the specification to a system should be applied mutatis mutandis to a method that may be executed by the system.

An alarm system comprises a miniature coin size tag attached to doors and windows. The tag has electronic 3 axial accelerometer with wireless notification system to user's smart phone.

The tag has auto learning capabilities, which automatically calibrate itself for sleep mode and wake-up alert mode.

The auto learning capabilities encapsulate several factors as accelerometer history jiggle. The user definitions jiggle level on its smart phone apps, time and date to activate, external weather situation like extreme wind or rain from the internet and proximity to the user smart phone The tag stays in power down mode, and wake-up to alarm state on door or windows juggle above the level define by the auto learning capabilities.

The user alarm on the smart phone can be done in several forms, like sound, smart phone vibration, automatic sending SMS, automatic phone call, internet message to security center.

The method may include the further step of providing an alarm signal security response when the jiggle accelerometer data encapsulated within the RF signal is received by the receiver means. The alarm signal may be audible, visible, or may be an electronic alarm signal which is transmitted to a remote internet alarm center via a telecommunications means such as a cellular link or Wifi network.

It is a further object of the invention to provide an accelerometer jiggle detection and alarm system which may be affixed to a wide variety of objects including inside doors, outside gates, garage doors, children's barriers such as "baby gates", valuable wall hangings and paintings, and countless other objects.

It is a further object of the invention to provide an accelerometer jiggle detection and alarm system which is portable and is easily packed in a suitcase and transported with a traveler to be later installed on motel or hotel room doors, windows and/or any objects within the room, whenever additional protection is desired by the traveler.

It is a further object of the invention to provide jiggle detection and alarm system that provides jiggle information to a remote location, such as a law enforcement or security agency.

It is a further object of the invention to provide jiggle detection and alarm system wherein the jiggle information includes an indication of the distance that is moved for measuring purposes.

It is a further object of the invention to provide jiggle detection and alarm system that provides object identification information either locally at or near the site of the object or remotely to a designated location such as a telephone number, email address, etc.

It is a further object of the invention to provide jiggle detection and alarm system wherein the object identification information is locally or remotely programmable.

It is a further object of the invention to provide jiggle detection and alarm system wherein tag and the radiating means are part of a remotely controllable trigger unit having both a radio transmitter and a radio receiver.

It is a further object of the invention to provide a security network that includes a security administration system operating in conjunction with an alarm system to provide security notifications to entities specified by network subscribers, and to optionally download security alerts and other information to the alarm system, where it can be accessed by the subscribers.

It is a further object of the invention to provide a sensor for detecting jiggle that does not rely on wire means to detect the jiggle of an object.

The present invention relates to a portable security alarm system which can be installed on a temporary basis and removed from an object whose jiggle is to be detected comprising a motion detecting and radio signal transmitting member, means for selectively coupling and decoupling said motion detecting and radio signal transmitting member relative to said object whose jiggle is to be detected, and a combined radio signal receiving and alarm generating member for receiving a signal from said combined motion detecting and radio signal transmitting member and producing an alarm. The alarm system may also include a smart phone apps remote control member for selectively actuating and de-actuating said combined radio signal receiving and alarm generating member. The alarm system may further include an information gathering device for gathering jiggle information and a remote notification device for providing the jiggle information to a remote location. The alarm system can be implemented such that the signal from the combined motion detecting and radio signal transmitting member includes an identification code that is used to provide object identification information either locally or to a remote location. Local or remote programmable means can be provided for selectively associating the object identification information with the identification code. The combined motion detecting and radio signal transmitting member can be adapted to provide distance information representing a distance moved by an object whose jiggle is to be detected. The combined motion detecting and radio signal transmitting member can also include radio signal receiving means and control logic means to facilitate remote control of the device for polling or programming purposes.

In additional embodiments of the invention, the alarm system of the invention is part of a security network that includes a user smart phone as security administration system for receiving security information from the alarm system and for notifying designated entities specified by network subscribers. The security administration system may be further adapted to download security alerts and other information, including advertising or other commercial information, to the alarm system, where it can be accessed by the subscribers.

In further embodiments of the inventions, a novel inertial sensor construction is provided that may be used in the alarm system of the invention or to perform other functions, such as activating or deactivating a device that may or may not be associated with a security function. The jiggle accelerometer sensor can be made shockproof event.

The foregoing and other objects and features of the present invention will become more fully apparent from the following description and appended claims, taken in conjunction with the accompanying drawings, which are not necessarily to scale. Understanding that these drawings depict only typical embodiments of the invention and are therefore not to be considered limiting of its scope, the invention will be described with additional specificity and detail through use of said drawings.

The wording "tag" referring to the jiggle monitoring alarm device as seen in the drawings.

The wording "smart phone" referring to any electronics devices that has Wi-Fi with Bluetooth Smart or other RF capacities, mobile or fix location base.

It is an object of the present invention to provide a one piece small tag jiggle monitoring as alarm device capable of sensing the jiggle of doors and windows and providing an alarm in response to that sensed jiggle condition.

It is another object of the invention to provide a tag that can be easily attached, by simple adhesive tape, to doors and windows in order to accurately sense of its jiggle motion condition and eliminate the need of professional installation or tools.

It is still a further object of the invention to provide a tag that has a wireless connectivity able an automatically connection to smart phone apps. Upon this wireless connectivity to broadcast alarm events and receive setting from any registered smart phones in parallel. For example if five smart phones are been registered with the tag, all five will be alerted.

It is still a further object of the invention to provide a tag that has a wireless connectivity and able automatically connected to any Wi-Fi with Bluetooth Smart or any other RF Bridge in its RF range automatically and in parallel with other RF devices.

It is still another object of the invention to provide a tag that detects jiggle accelerometer monitoring as alarm device that is easily operable and does not require multiple electrical connections to be made between separate parts.

It is still a further object of the invention to provide a tag that has a wireless broadcast with encapsulate digital data information as tag location, tag name, incremental jiggle data, RSSI proximity, battery information, tag RF MAC address, tag infra-red readings, tag real time clock setting and more alike.

It is still a further object of the invention to discloser the method where the tag smart learning algorithm and automatic set the jiggle tag wake up level per old history accumulated jiggle data.

It is still a further object of the invention to discloser the tag method to move to sleep mode and to cut the power of its battery automatically when the alert level from the jiggle accelerometer is below that level.

It is still a further object of the invention to discloser the method where the tag rear side has an infrared distance temperature sensor. This infrared sensor can detect the infrared radiate from the surroundings environment, outside the windows. This sensor can detect burglar body temperature before touching the window. The tag feeds the surroundings environment temperature into the tag auto learning algorithm and automatic sets the jiggle Infrared wake up level. Since background temperature can be close also human temperature, only fast jiggle temperature recognizes as of moving human body to trigger the alert.

It is still a further object of the invention to discloser the tag method to broadcast the surroundings environment temperature outside windows in a way that offices and homes heating and cooling system can received this wirelessly information to automatically preserve energy.

It is still a further object of the invention to discloser the tag electronic design as GREEN TECHNOLOGY alarm system. The tag green technologies expressed in its design upon the tag by cutting the tag power from the battery when the jiggle accelerometer level is below the wake-up level. The alert system, tag and smart phone, do not use any wires and therefor no waste of any copper wires. There is no use of center box, just reuse of exiting smart phones. The tag was design to consume very low energy. Tag's battery can last several years. Moreover, since the tag broadcast the outer window surroundings environment temperature, offices and homes heating and cooling system can received this wirelessly information to automatically preserve energy by automatically adjustment.

It is still a further object of the invention to discloser the method where the tag auto learning algorithm automatic set the jiggle tag wake up level per weather information, pulled from the smart phone apps internet connection.

It is still a further object of the invention to discloser a method where the tag pulls, the user selection of jiggle accelerometer wake up level, from smart phone app.

It is still a further object of the invention to discloser the tag method to be on sleep, low battery consumptions and wake up only when jiggling increase above the level sets by the tag auto learning function.

It is still a further object of the invention to discloser the tag method to be periodically self-wake up from sleep base on real data/time clock chip, just send smart phone apps a "keep alive message" with tag information and battery voltage level.

It is still a further object of the invention to discloser the tag unique 10 pin connector. This connector enhances the functionality of the tag by external added accessory. As other sensors, actuators and enabling plug-in to external devices.

It is still a further object of the invention to discloser the tag connector digital output lines and wireless link them to smart phone apps. In a way the smart phone apps can send 3V or 0 logic on that lines and activate external units.

It is still a further object of the invention to discloser the tag connector digital input lines and wirelesses link them to smart phone apps. In a way the smart phone apps can detect the external level on those lines. For example: external switch or other digital sensor.

It is still a further object of the invention to discloser the tag connector digital bus devices as I2C and UART and wireless link them to smart phone apps for input and output.

It is still a further object of the invention to discloser the tag connector analog input lines. And wirelesses link them to smart phone apps.

It is still a further object of the invention to discloser the tag connector analog output lines. And wirelesses link them to smart phone apps.

It is still a further object of the invention to discloser the method where the smart phone app tag alerts the user by local sound, sending SMS, human voice, Voice call, Email, web data base connection and more alike.

It is still a further object of the invention to discloser the method where the tag alerts, in parallel all users smart phones app.

It is still a further object of the invention to provide a tag that has a simple inner construction, enabling the device to be manufactured at a very low cost.

It is still a further object of the invention to reveal the tag method to detect the near proximity to smart phone and the outcome proximity to user, and temporarily disable the alert trigger if the user touches window or door.

The present invention is a jiggle monitoring tag acts as alarm device that can be used to detect any jigging of the surface the tag is attached to. The home residence confidence is gained by detection of any attempt to intrude their home. The residence may no longer need to install a costly alarm system, no need to place wires all over the house or pay monthly fees to Security Company.

The tag has a unitary housing which encloses all sensing and actuating parts of the device.

The tag housing uses an adhesive two side tape to attach to any surface.

Within the interior of the housing, the tag includes an 3 axial accelerometer with firmware code that transforms it to jiggle accelerometer capable of sensing the jiggle of the surface to which the tag is attached to. The jiggle accelerometer is formed as a monolithic integrated circuit chip that incorporates an electronic sensor. The chip is connected to controller which receives the digital I2C output signal from the jiggle accelerometer and determines whether a jiggle motion condition exists based on the output signal from the jiggle accelerometer.

The controller has an auto learning application that can learn the history of non-alert 3 axial jiggle accelerometer levels of the surface and programed the accelerometer to wake up tag above that level. The added above level is calculated by the user selection from the smart phone apps and internet weather information.

The tag wake up jiggle level is stored inside the jiggle accelerometer chip. And only when its jiggle level is above that level, jiggle accelerometer chip send output wake_int signal. This wake_int signal activates the circuit that connects the tag battery to all the tag components. The jiggle accelerometer has its own bypass connection to battery and consumes neglected power on sleep. When tag power up, the tag controller will initiate transmit wirelessly the jiggle information with the tag information to all the smart phones app in range.

The tag has a real time clock that periodically send wake_int signal. This wake_int signal activates the circuit that connects the tag battery to all the tag components. The jiggle accelerometer has its own bypass connection to battery and consumes neglected power on sleep. When tag power up the tag controller will initiate transmit the battery voltage level and keep alive message to the tag smart phone apps.

The tag accumulates data from user defining of wakeup jiggle alarm level, increment data during normal windows and doors vibrations and weather information from the internet. Base on this accumulated information the trigger power up level for activation is sending to the tag.

On the very first time tag installing and the smart phone apps, the smart phone apps will send the tag to maximum jiggle sensitivity and it will learn the self-vibration of the surface the tag attached. These normal vibrations levels will graphically present this information to user smart phone apps and allow easily move an horizontal line above these levels to wake up the tag and detect intrusion.

The smart phone apps will allow users to select the kind of alert on intrusion event.

The tag has also inner buzzer. The tag buzzer will activate only by command from the smart phone apps or autonomously when none of the user's smart phone is in range. The tag will attempt to startle the burglar. However, if the alarm condition didn't persist due to a continued non-jiggling motion of the surface, the noise generated by the buzzer will stop. Once the device detects jiggling motion by the surface, the device will activate the buzzer as an alarm condition.

Various alternative embodiments and modifications to the invention will be made apparent to one of ordinary skill in the art by the following detailed description taken together with the drawings.

There may be provide a coin size tag adhered to a surface, wirelessly sensing of jiggling motion, to smart phone apps, the tag may include a jiggling accelerometer formed as a monolithic integrated circuit chip adapted to sense a movement of the surface and to generate a jiggling accelerometer data output signal in response to the jiggling movement of a surface containing an output signal component within a specific signal range; a controller connected to the jiggling accelerometer output and uses it to analyze the jiggling accelerometer output signal; and a sensory perceptible signal generator connected to the controller and selectively active by the controller in response to the jiggling accelerometer output signal wherein the accelerometer, the controller and the sensory perceptible signal generator are contained within a housing. The controller wirelessly sends its jiggling accelerometer data to smart phones apps. The alert trigger level of the jiggling accelerometer may be calibrated by user of the smart phone apps. Wherein the sensory perceptible signal generator may be an audible alarm. Wherein the alarm may be activated also by infrared remote temperature sensor. Wherein the tag sends its battery level and reports to the smart phone apps. Wherein the tag housing includes means for easy and fast securing the tag housing to the surface of windows and doors. Wherein the jiggling accelerometer data may be feed to auto learning algorithm which auto calibrates the trigger and auto wake up level of the tag. Wherein the tag may include a battery power cut off circuit calibrated when level may be below the wake up level set by the auto learning algorithm. Wherein the tag may include a real time clock to auto active or de-active during the day or dates. Wherein the tag may include auto learning algorithm that uses the output data from infrared body temperature sensor, for auto calibration of the infrared body temperature sensor to auto wake up level of the tag above temperature pre define temperature range. Wherein the controller may be formed as a programmable integrated circuit chip. Wherein the tag may include a power source connected to the controller. Wherein the power source includes at least one battery. Wherein the power source, the battery, may be disposable. Wherein the tag power source may be connected to the controller by electric operable switch. Wherein the controller includes an analog to digital signal, digital to analog signal converter and programmable digital input and output signal. Wherein the controller analog to digital signal connected to the tag connector. Wherein the controller digital to analog signal connected to the tag connector. Wherein the controller programmable digital input and output signal connected to the tag connector. Wherein the controller includes a UART signal link with an option to be connected to external enhancement devices.

There may be provided a method of sensing a jiggling motion of a surface, the method comprising the steps of: providing tag for sensing a jiggling motion, including a housing, a jiggling accelerometer formed of a monolithic integrated circuit chip within the housing and adapted to create a jiggling accelerometer output signal in response to a movement of the surface, a controller within the housing and connected to the jiggling accelerometer and adapted to receive the jiggling accelerometer output signal, and a sensory perceptible signal generator within the housing and operably connected to the controller; Activating the device; Attaching the device to the surface; Detecting a movement of the surface to create the accelerometer output signal, and Activating the sensory perceptible signal generator in response to the jiggling accelerometer output signal to encourage spontaneous movement by the surface if movement may be detected.

The device may include a securing means of attaching the device to the surface comprises engaging the easy securing means to the surface.

The tag may include auto learning algorithm that accumulate all sources of information data before setting the activation level of the tag, as: Jiggle accelerometer amplitude history. Jiggle information from those infra-red remote temperature sensors The tag may broadcast the out of the windows external environment temperature in such a way that heat and cooling house devices can use this information to preserver energy by adapting their functionality to external temperature.

Setting Information wirelessly received from user smart phone apps as: Weather information, which affect the Jiggle accelerometer and the Jiggle information from that infra-red remote temperature sensors. User selected alert sensitive level. Date time of the tag activation. Wireless link to user smart phone as a mean of activate or deactivate the tag The tag temporary may disable its alert activation base on proximity to the user smart phone, to allows the user with its smart phone to open windows and doors without activate the alert The device controller firmware can be update over its connector The device controller firmware can be update over the air from the tag smart phone apps The tag controller firmware can act as "slave" to send all information to smart phone or as "slave" and "master" to bridge information from long distance tag to the smart phone. In this mode the tag wirelessly sends its data to smart phone apps and all data been received from other tag around it.

The tag can work in parallel in the same area and report in parallel to several smart phone apps.

The tag apps can report to different apps with the same smart phone, in none blocking mode. And expose open interface to get event and set settings.

The following detailed description of the embodiments of the present invention, as represented in FIGS. 1-16, is not intended to limit the scope of the invention, as claimed, but is merely representative of the presently preferred embodiments of the invention. The presently preferred embodiments of the invention will be best understood by reference to the drawings, wherein like parts are designated by like numerals throughout.

FIG. 1 shows, in pictorial all tag parts. The tag itself 1. And the internal major components of the tag present invention. The tag battery cover 10. The tag battery 20. The tag top plastic case 30. The tag PCB 40. The tag plastic ring 80. The tag on/off button 50. The tag function button 51. The tag bottom plastic 60. The tag adhesive sticker or finish plastic 70. The tag adhesive sticker allows the tag to easy attach to any windows or doors.

Figure 14:
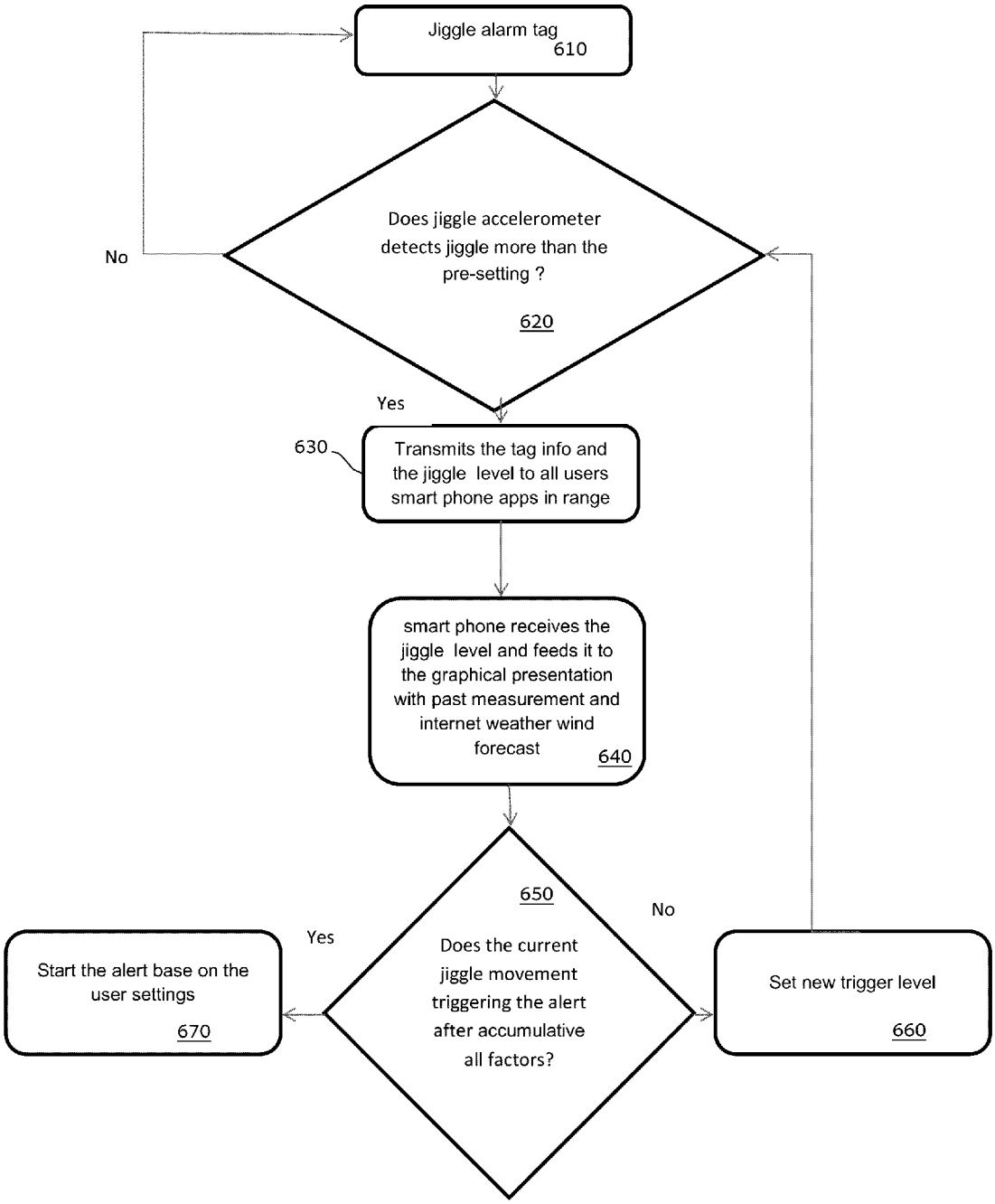
FIG. 14 showing flow chart of jiggle alarm tag detection to user smart phone apps and auto calibration its trigger level according to one embodiment of the present invention.

More than one tag 1 may be utilized in implementing the system of the present invention. One tag 1 may be placed on each object whose jiggle movement is desired to detect. For example, in a place with four windows and two doors, six tags detecting means 6 tags may be utilized, one on each window and one on each door. However, minimum one smart phone apps FIG. 14 is necessary regardless of the number of tag be in used. There is no limit to the number of tags which may be used with one smart phone apps. There is no limit to the number of smart phone apps, within one smart phone may be used to interact with all the tags. There is no limit to the number of smart phone may be used to interact with tags. Meaning with the same location, may be many smart phone getting notification from all tags simultaneously. Moreover, on every smart phone can be several apps that can use tags notification to do parallel tasks.

Accordingly, a window may be left in a partially open position, as for example, to provide fresh air to a room, while the occupant (resident) attends to other matters, or sleeps.

Any jigging or tag displacement from the partially open position will cause the alarm signal to be generated. Even in a situation wherein an intruder reached into the window and removed the tag, the jiggling data would be transmitted and the alarm generated on the smart phone, thus warning the occupant of an intrusion.

Figure 2:
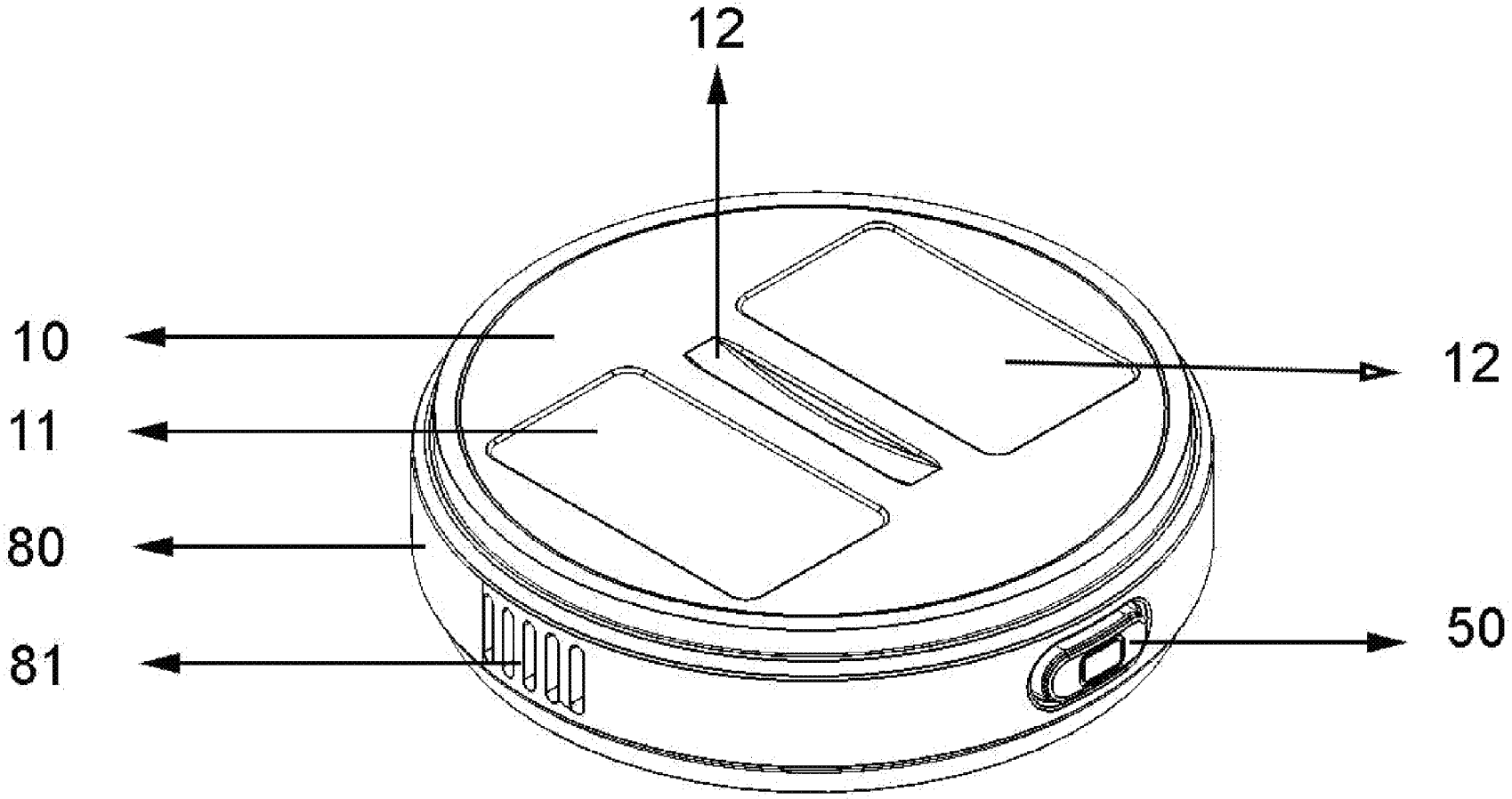
FIG. 2 is a perspective rear view of jiggle alarm tag according to one embodiment of the present invention.

FIG. 2 shows, in pictorial all tag external parts. The tag ring 80. The ring windows 81 to let the buzzer sound out. The tag on/off button 50. The tag label 11 QR code to automatic download the smart phone apps. The tag security number 12 to secure pair with the smart phone apps. The tag QR code and the security code prevent from others smart phone apps to control the tag. The tag battery coin open cavity 21. Tag battery cover 10.

Figure 3:
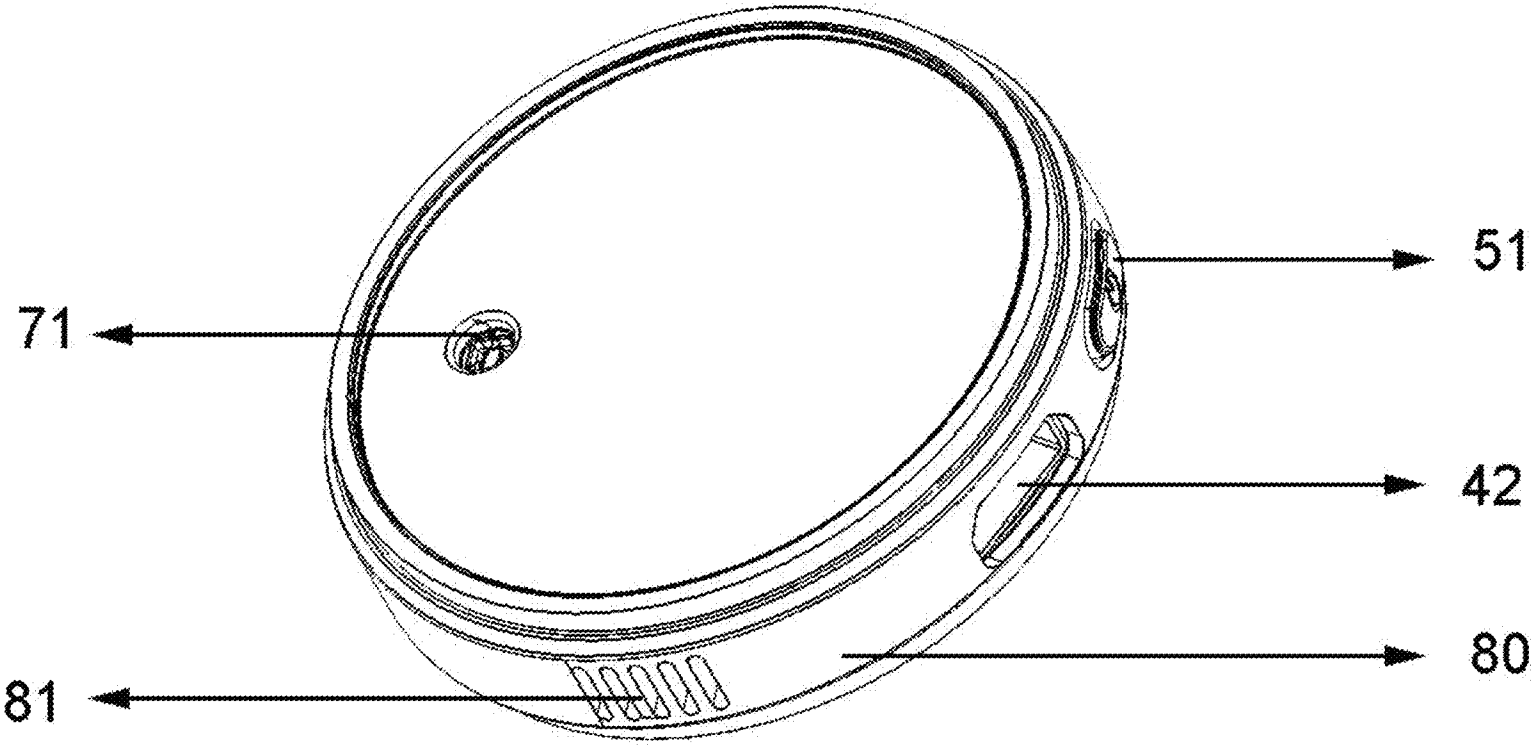
FIG. 3 is a perspective front view of jiggle alarm tag tiled to left according to one embodiment of the present invention.

FIG. 3 shows, in pictorial all the tag back side. This side sticks to windows or doors. The button functions selector 51. This button can select different mode of operation. For example: long pressure on button 51 moves the tag to auto recognize state (or "pair") with the smart phone apps. And add the smart phone unique identify number to a white list inside the TAG. This white list allows only the registered smart phone apps to command the tag and to get jiggle data. Connector 42 is an extension port. It allows program the devices with different firmware; add external devices over digital and analog wires. It allows power the tag from external power source, or to feed power to external devices. The tag connector 42 supports server mode of operations, digital output PIO as 3V and GND. Digital input as PIO as 3V and GND. Digital busses as I2C and UART, to connect to more sensors as Gyro, digital compass, smoke, fire, humidity, gas, pressure, Co2, CO, pollution, sound, light, barometric, medical devices and more alike. This connector 42 enables to send command to external devices to activate them, for example door looker, room light, garage door opener. Or send and get data from external CPU and more alike. Windows 81 allows the buzzer sound to be heard outside the tag. And 80 is the tag cover ring. The tag has an infrared remote human body temperature pick-up sensor 71, point outside of the windows. Around the sensor there is a sticker that sticks the tag to windows or doors. The sticker has hole for the infrared temperature sensor 71 path.

Figure 4:
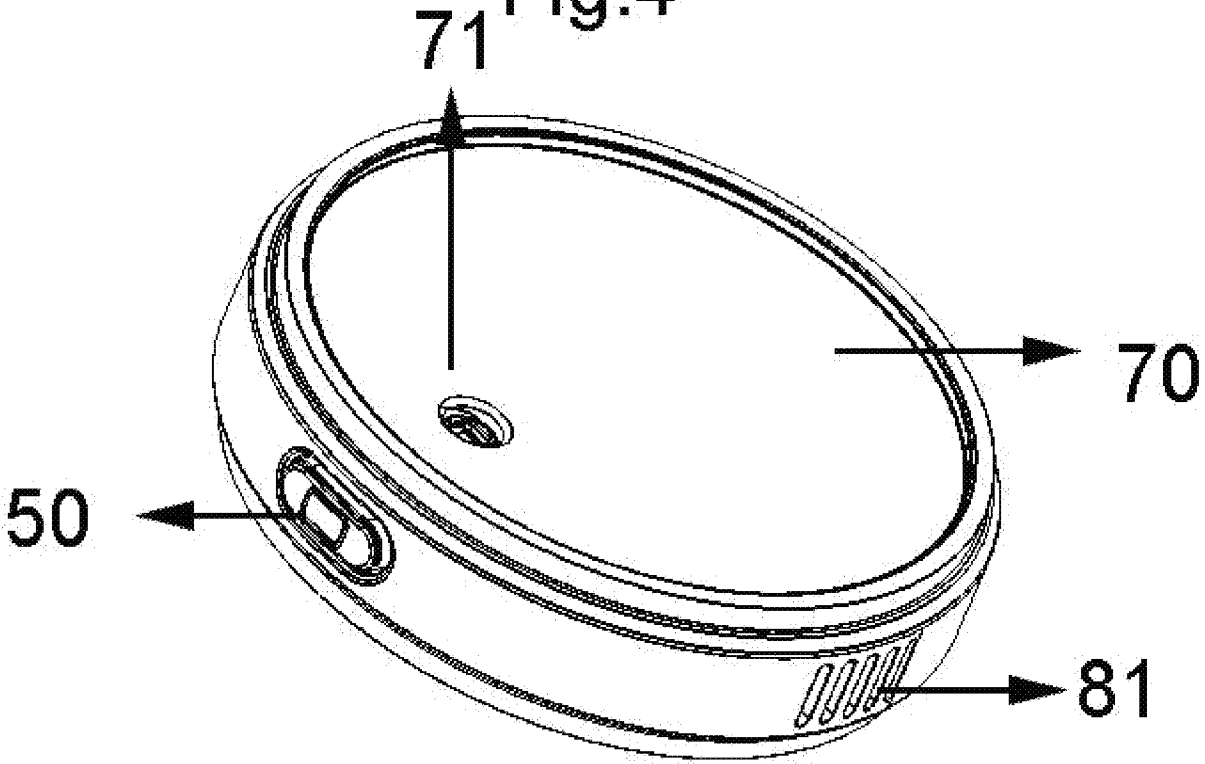
FIG. 4 is a perspective front view of jiggle alarm tag tiled to right according to one embodiment of the present invention.

FIG. 4 shows, in pictorial all the tag back side as FIG. 3 with the sicker place 70. The tag on/off switch 50.

Figure 5:
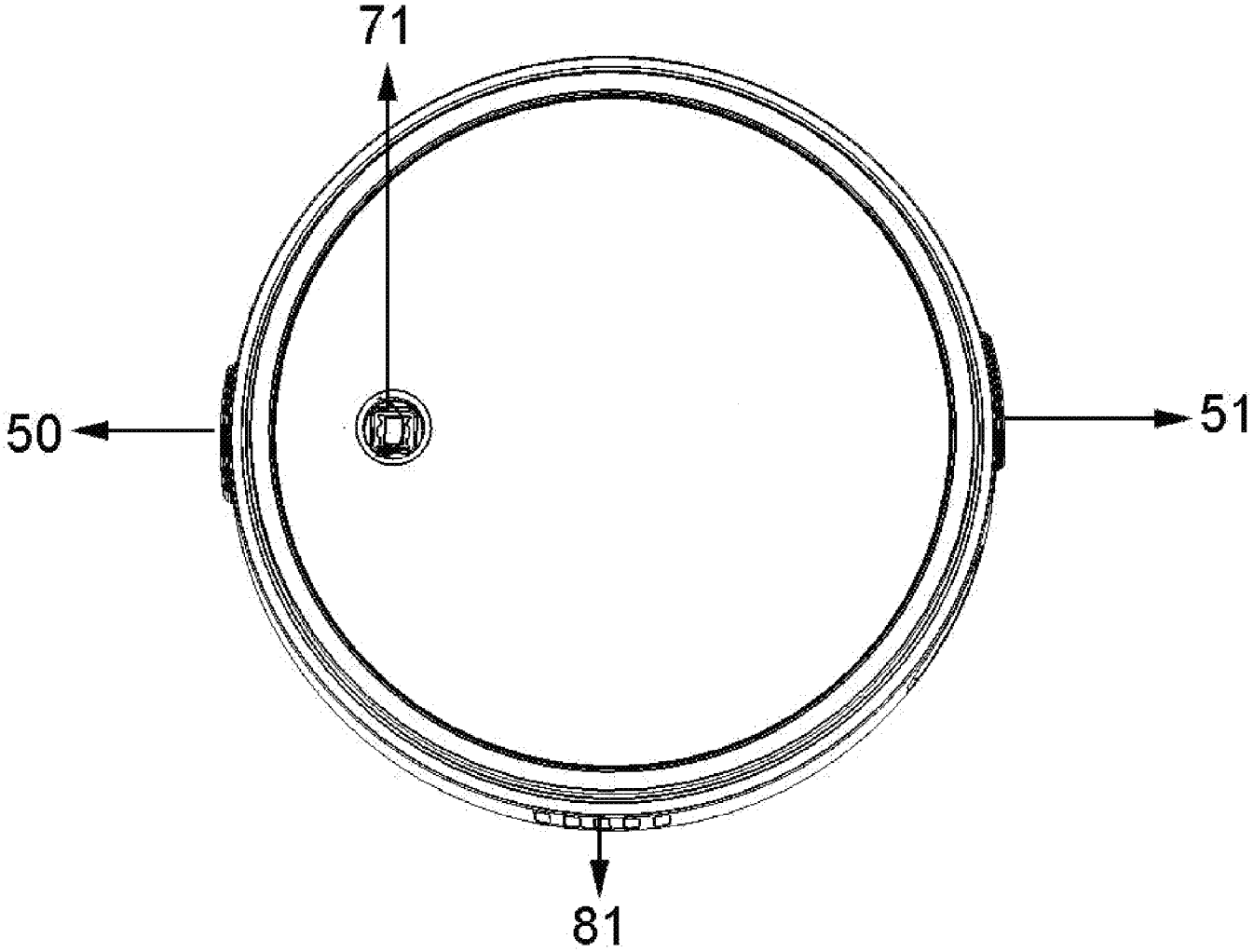
FIG. 5 is a perspective front view of jiggle alarm tag according to one embodiment of the present invention.

FIG. 5 shows, in pictorial the tag from front. All parts are described already in FIGS. 1-4.

Figure 6:
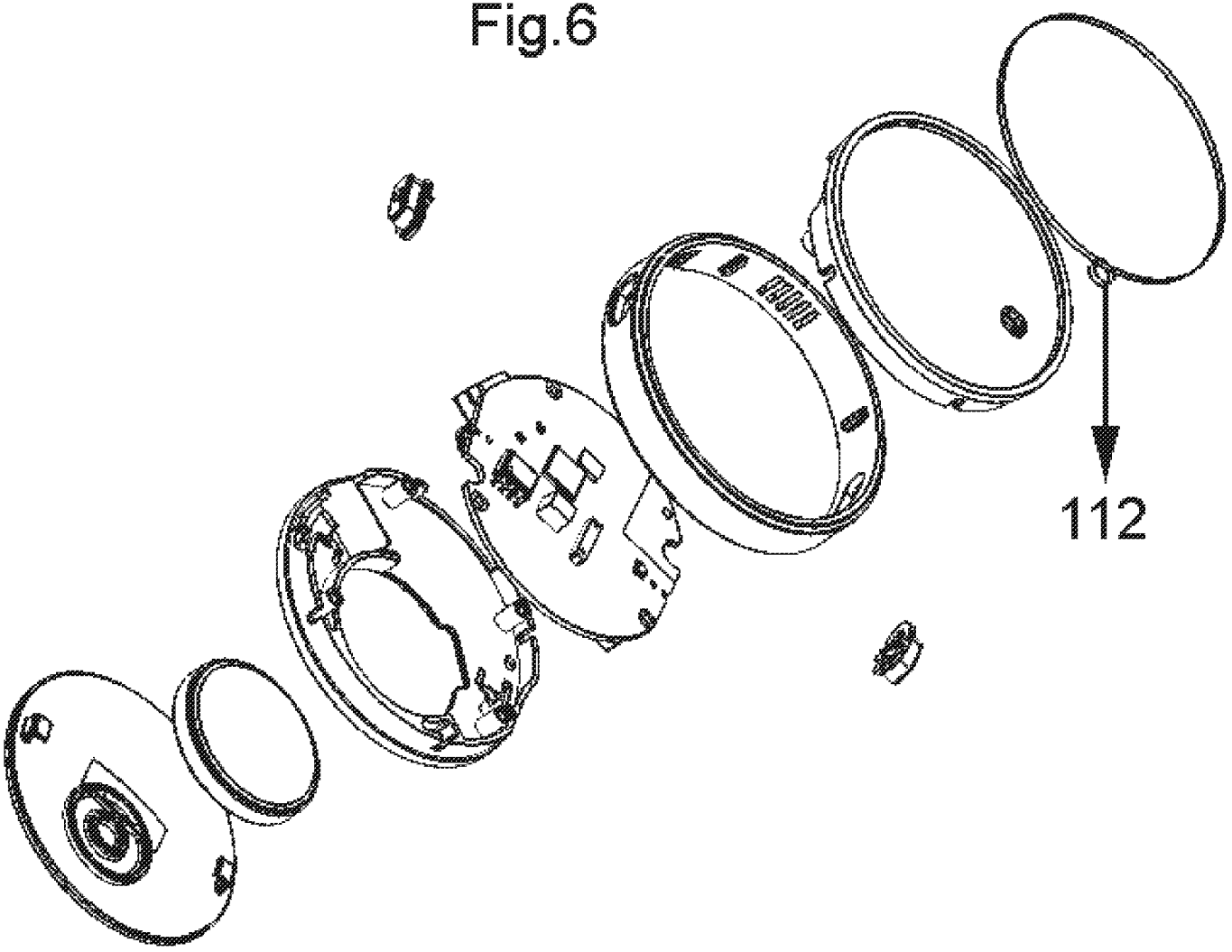
FIG. 6 is an explode view, pictorial diagram showing the other side of a jiggle alarm tag according to one embodiment of the present invention as they appear inside the tag.

FIG. 6 shows, in pictorial the tag open when its PCB where the components side is shown. The tag infrared remote human body temperature cover plastic hole is 112

Figure 7:
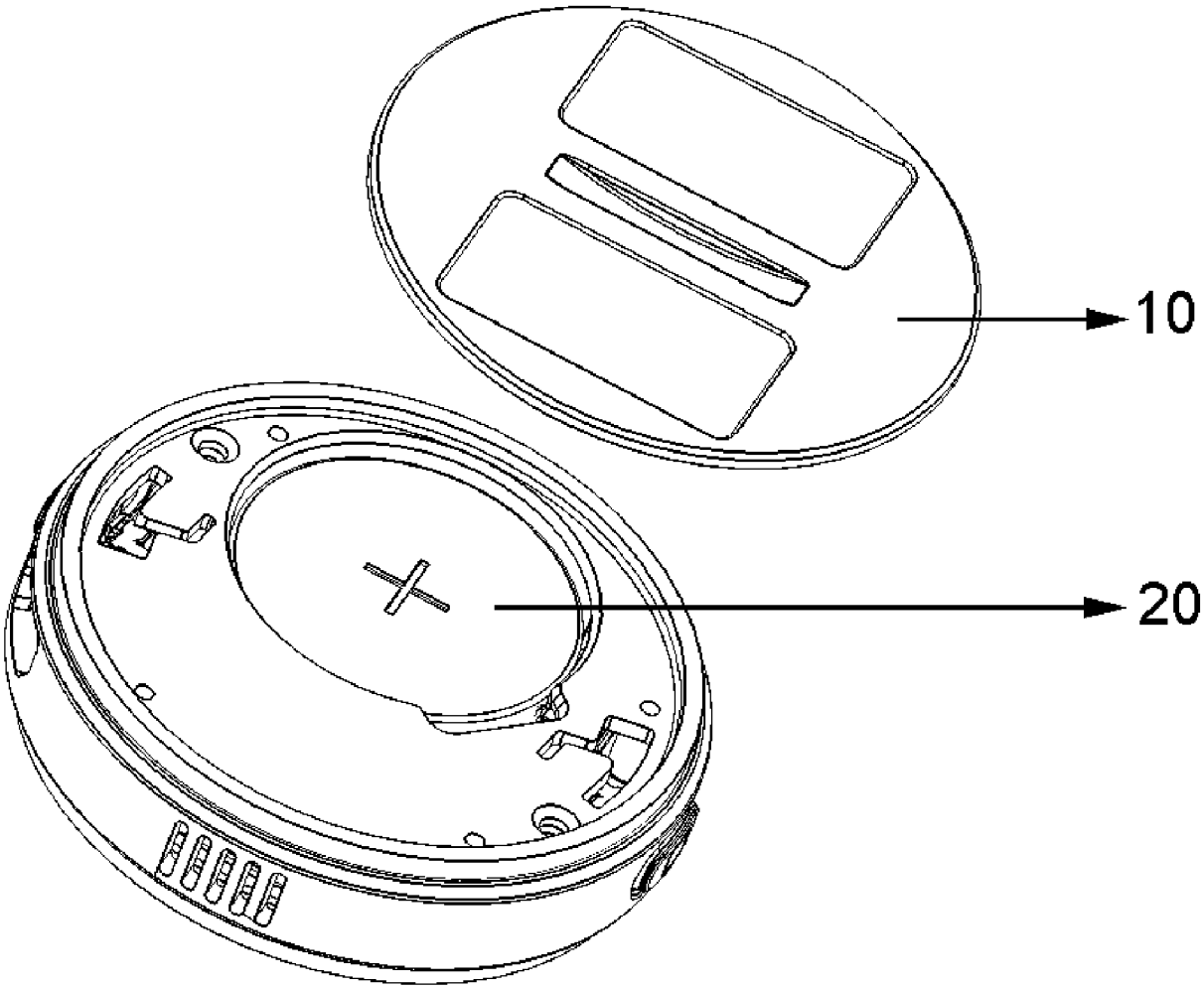
FIG. 7 is a perspective rear view of jiggle alarm tag with battery cover open according to one embodiment of the present invention.

FIG. 7 shows, in pictorial the tag battery cover 10 and the place of the battery 20. The battery type is CR2032.

Figure 8:
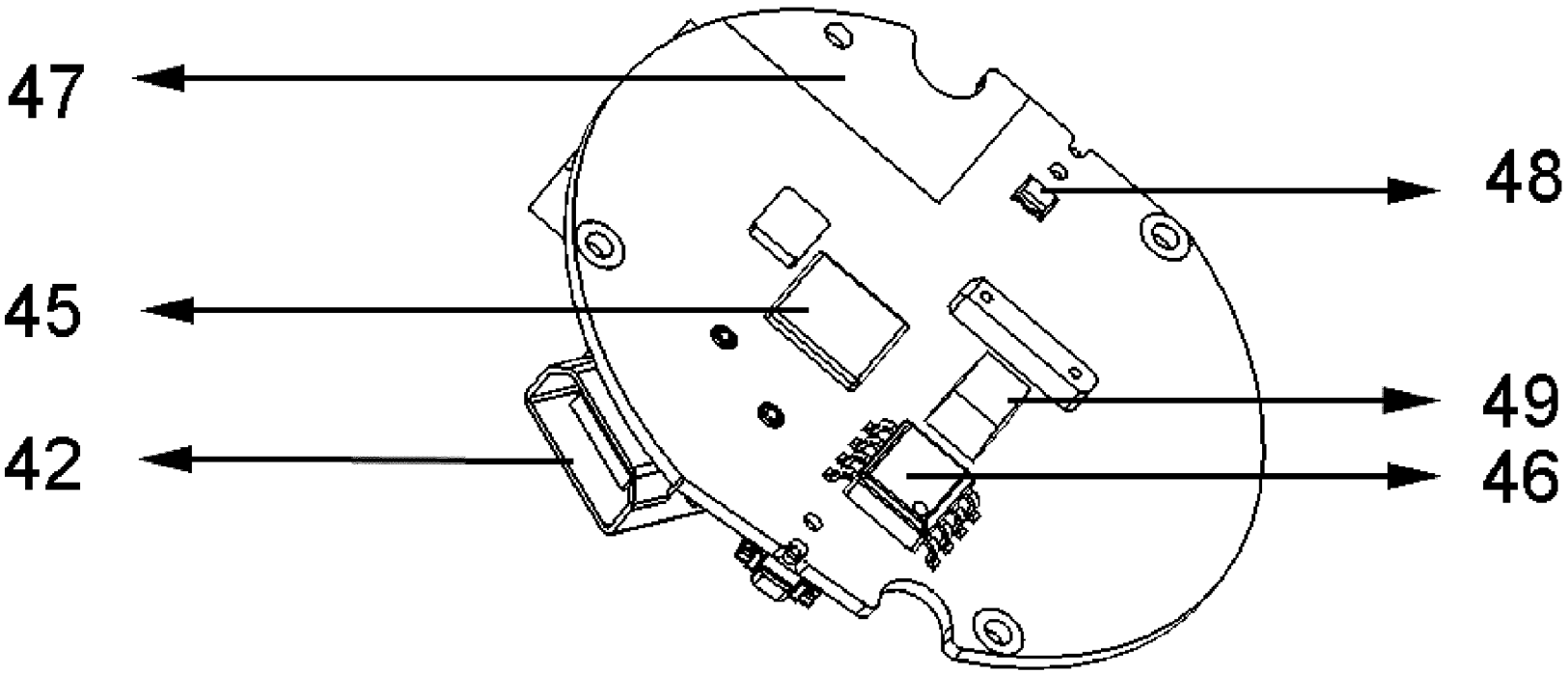
FIG. 8 is the jiggle alarm tag PCB, component's side according to one embodiment of the present invention.

FIG. 8 shows, in pictorial the tag PCB component side. The infrared temperature sensor 48, part number tmp006. The place of the printed antenna 47. CSR1010 tag controller and RF transmitter 45. Connector 42. The tag memory AT24C512C-XHM-T 8-lead TSSOP 46. The tag jiggle accelerometer MMA7660FC 49. The present invention is not limited to this unique parts number, and any other chips with same functionality also may be used.

Figure 9:
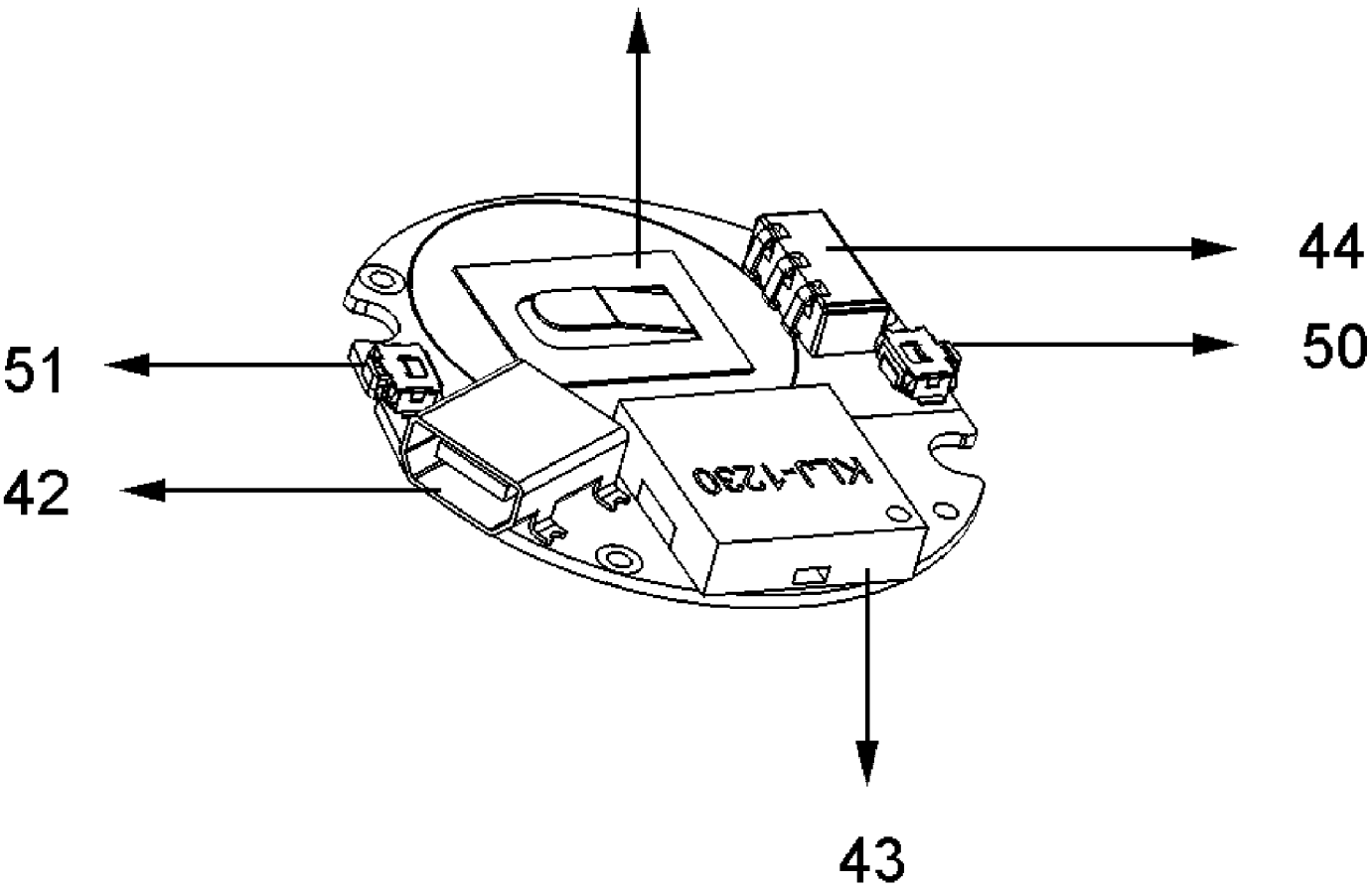
FIG. 9 is the jiggle alarm tag PCB, connector's side according to one embodiment of the present invention.

FIG. 9 shows, in pictorial the tag PCB connector side. The battery side holder 44. The tag on/off button 50. The tag buzzer 43. The tag connector 42. The tag function button 51. The battery spring holder 41.

Figure 10:
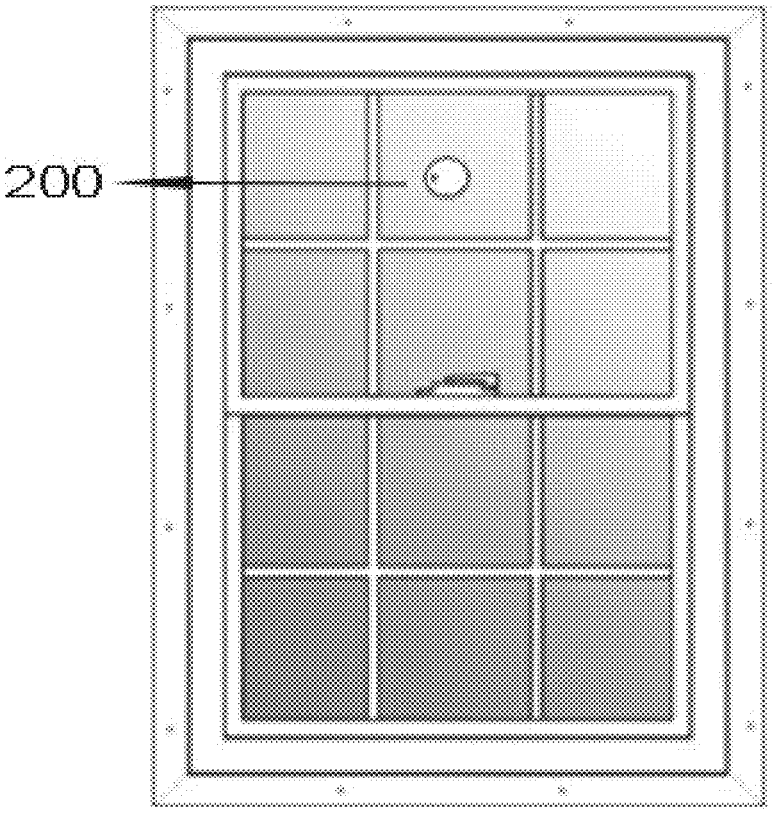
FIG. 10 showing possible location of the jiggle alarm tag on windows according to one embodiment of the present invention.

FIG. 10 shows, in pictorial a possible locating of the tag on windows 200. It can detect jiggle of the glass as an attempt to unlock, a jiggle movement when windows pull down, or breaking the glass.

Figure 11:
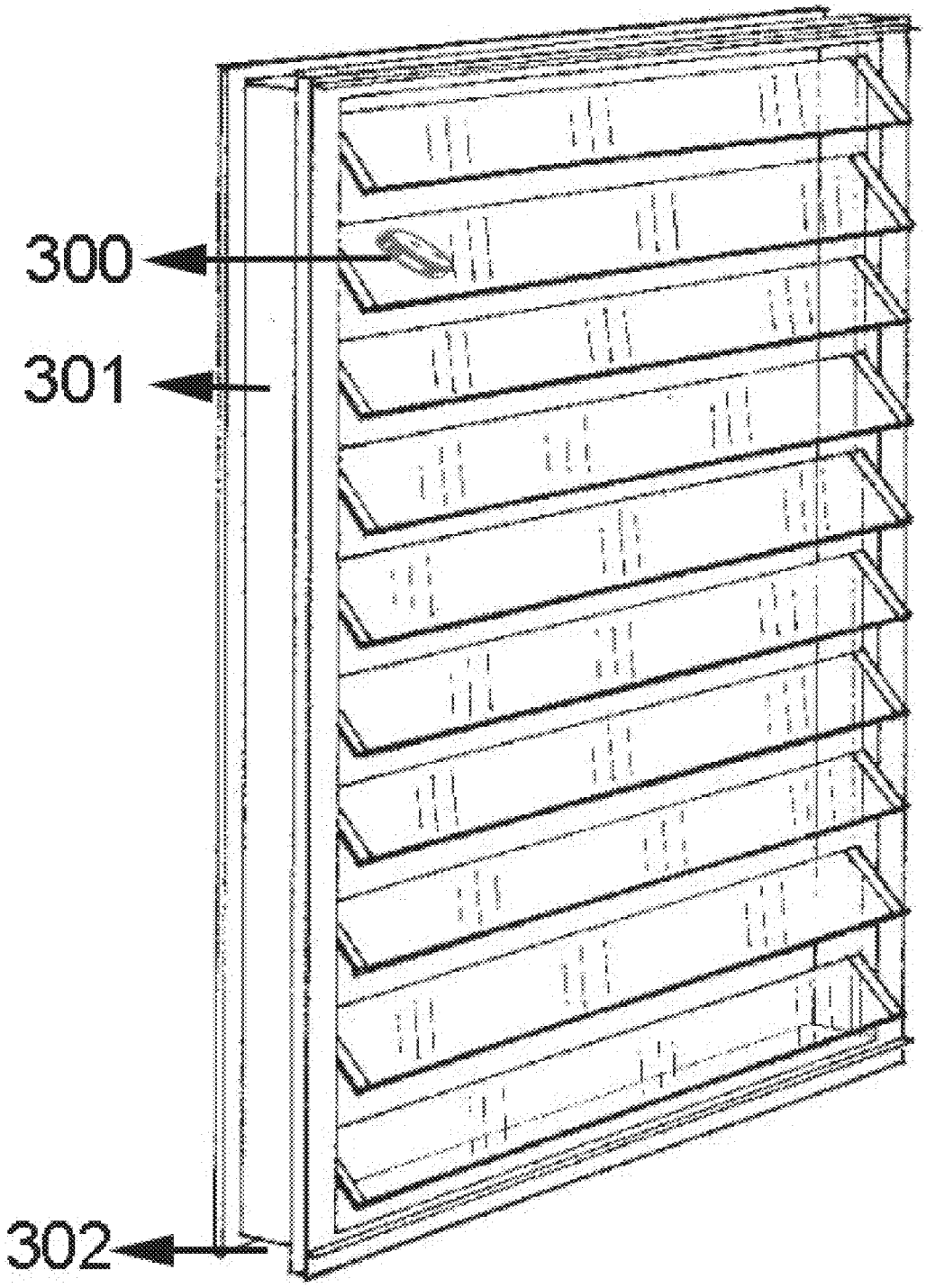
FIG. 11 showing possible location of the jiggle alarm tag on window louvers according to one embodiment of the present invention.

FIG. 11 shows, in pictorial a possible locating of the tag on windows louvers. The jiggle accelerometer will detect any deposition of louvers. Also it can detects moving the windows up or down 301, as in attempt to take the windows totally from its rails, or move it to some side over its rail 302.

Figure 12:
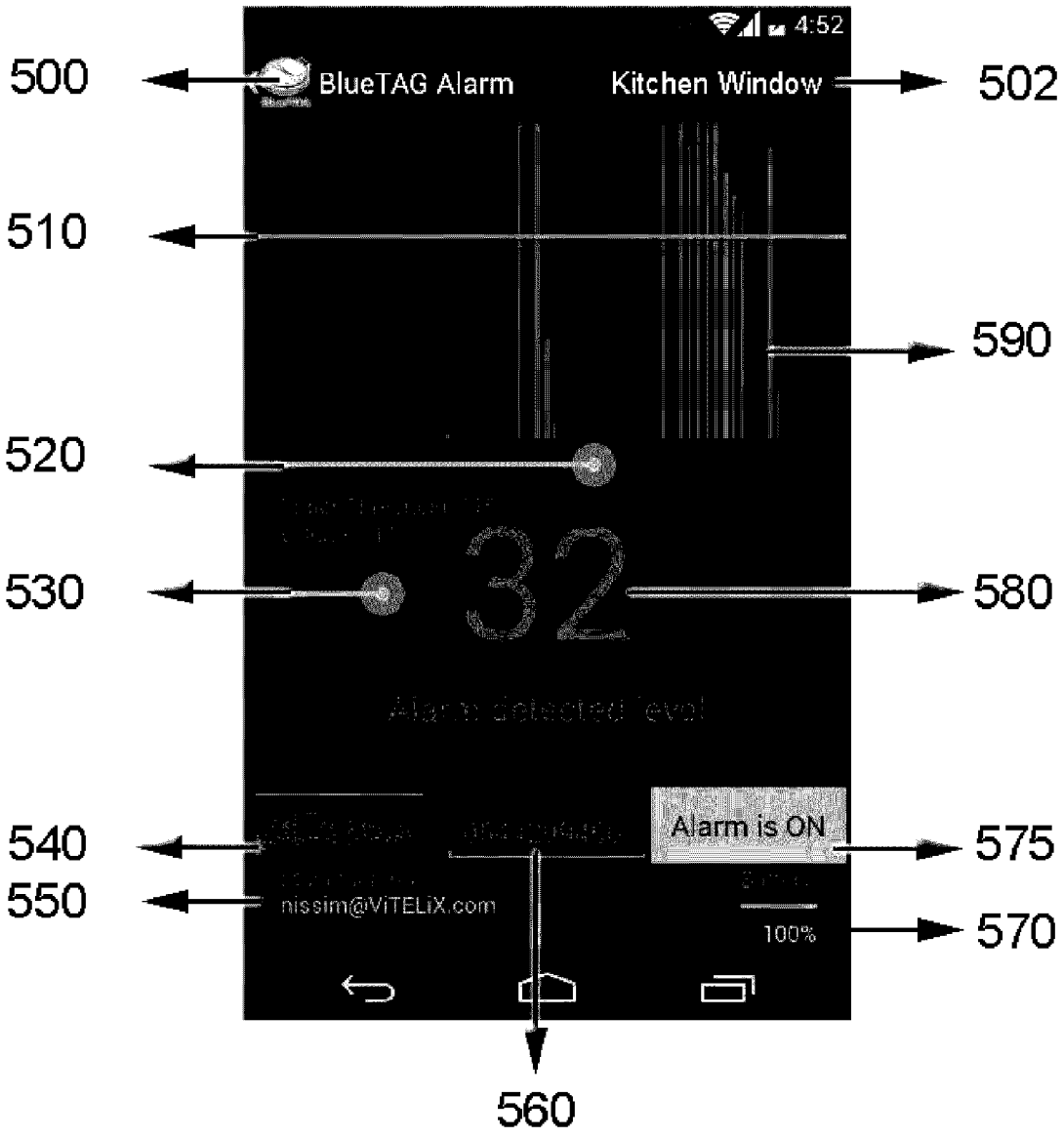
FIG. 12 shows, in pictorial the smart phone screenshot according to one embodiment of the present invention.

FIG. 12 shows, in pictorial the smart phone apps. The tag name 500, since same smart phone app can handle many tags in same time. Location of the tag 502, in this example: the tag attached to Kitchen Window. A graphical display of vertical lines of the jiggling accelerometer inside the tag 590, the wake up alert level defined by the user 510. The user moves the button 520 right and left, and bar 510 moves up and down to show the trigger level. In this example: the Kitchen Window alarm tag. The trigger alert 510 level is one on the input to the auto learning algorithm on the tag, and not necessarily defines absolute level. The user may override the auto learning algorithm and defines hard absolute trigger levels. The jiggle value of the last detection 580. For example: in the example it is level 32. Since the 520 alert levels are much higher, this 32 value do not trigger alert situation. A toggle button 575 from alarm active to non-active state and shutdown the alert from this tag. In this example it may turns off tag at Kitchen Window.

The alert sound level bar 530 on the user smart phone.

The user may define general behavior to all tags at home. For example to auto trigger on all tags when one leaves the house with its smart phone, and auto trigger all off when returns home. The presence of the smart phone in RF range may be the trigger to change state.

The user also can define all tags or selected tag to switch to on automatically at certain time and off at other time. Since the tag utilizes a real date time chip 440.

The tags also detect proximity to the user smart phone, therefore when the user jiggle windows or doors, the alert will not be active since the tag detects the user standing in front of the window or a door, by the proximity to the smart phone. That allows the user to open doors and windows also when the tag is on its on active alarm detecting state.

The tag has a "call rescue" button 540, so user may click on it, and the smart phone will dial a pre define number 560.

The tag battery level 570, in this demo case the tag location is at the Kitchen Window.

Figure 13A:
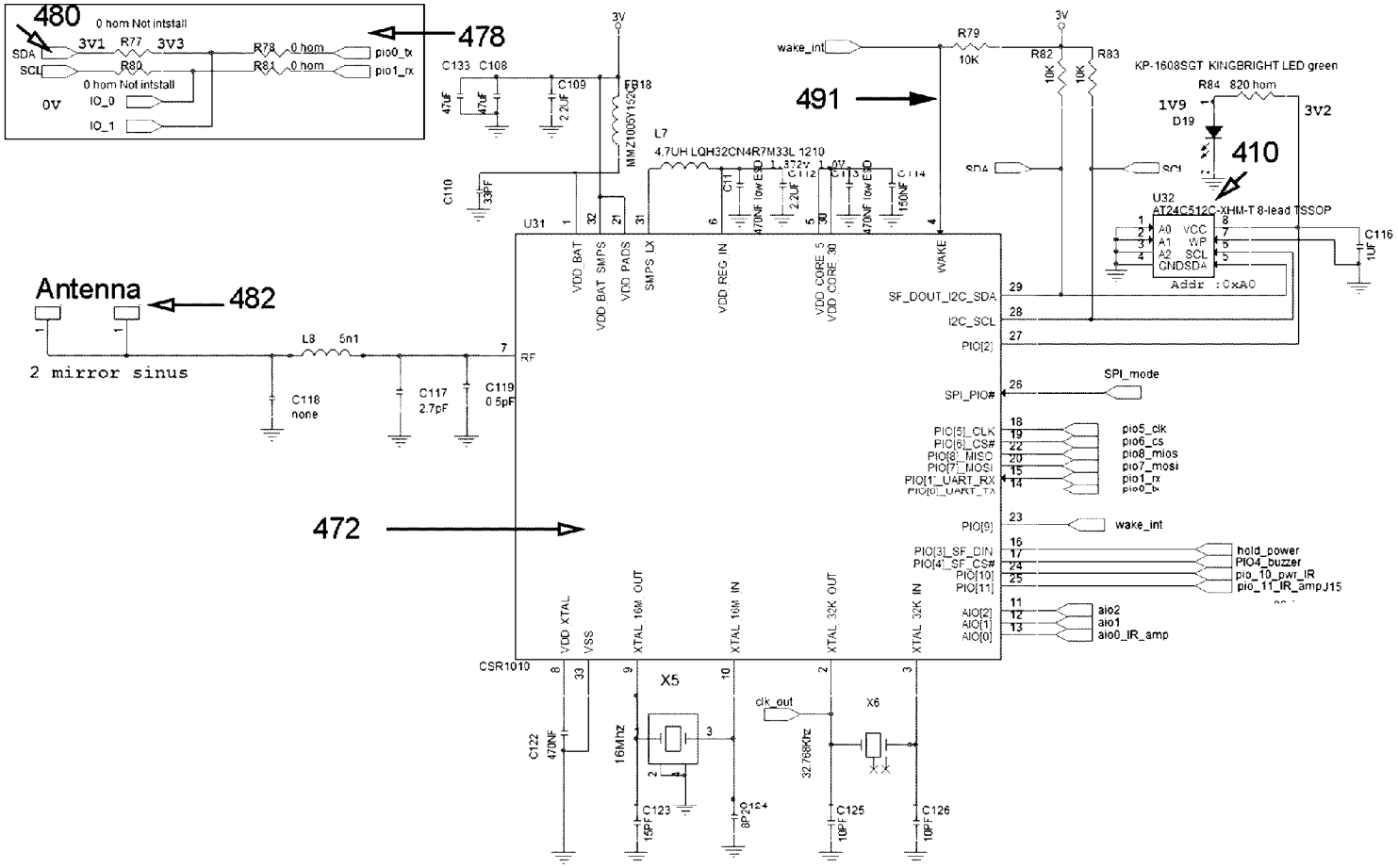
FIGS. 13A and 13B are the jiggle alarm tag schematic electronic diagram according to one embodiment of the present invention.
Figure 13B:
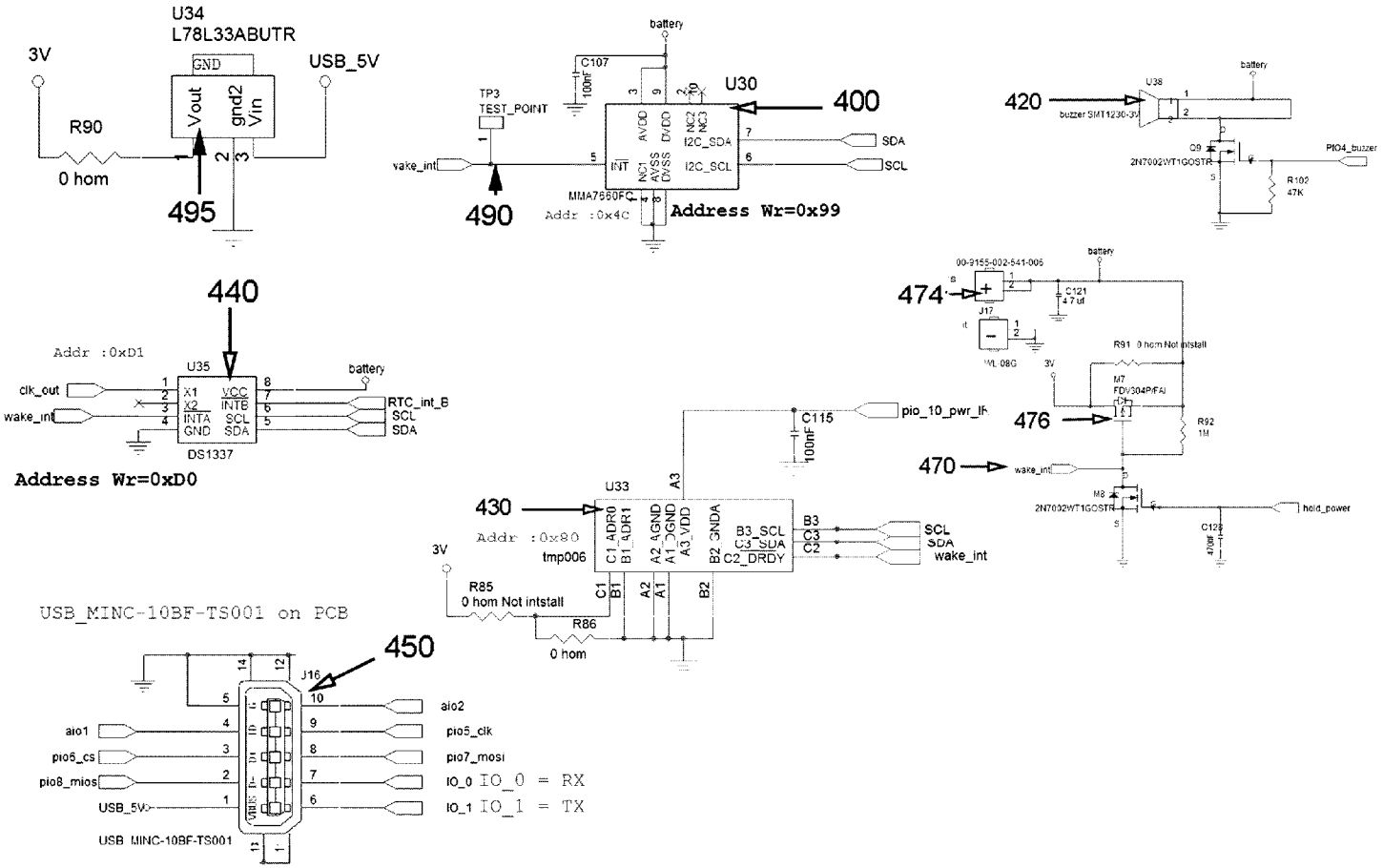

FIG. 13 shows in details the tag electric schematic diagram. The schematic is self-explanatory for enabled one skilled in the art to make and practice the invention. Several skilled in the different art fields needed to make and practice the invention. An hardware design engineer. An RF design engineer, a firmware software designer, an algorithms designer, a power supply designer for the green technologies compliant, mechanical plastic designer, and a smart phone apps designer. All components data sheet are at the public domain and easy be retrieved. The present invention does not limit itself to the present selection of the components and any other components with the same punctuality can easily be use.

The tag controller 472 manufactured by CSR, with part number CSR1010. It has the processing power and the algorithm to convert the accelerometer 400 Mma7660 from ordinary accelerations reported to jiggle accelerometer, with capability to send wake_int 490 signal when the jiggling is above defined level. The controller 472 communicated with 400 over I2C bus.

Converts from the accelerometer acceleration values to accelerometer jiggling values the controller 472 computes its velocity in 3 axis, its displacement values in 3 axis and time passed from any pick in above 3 axis. The formula to convert measurements of acceleration and converts it to displacement, velocity over time is a common knowledge to one skilled in the art to make and practice the invention. This invention converts these 3 values, displacement—velocity—time in a unique in non-obviously way to get a jiggling value. The controller 472 builds a table with these 3 fields. In that field the maximum values of displacement in one field, velocity in second field is recorded, when the time is in the third field. The jiggling value is the delta between the minimum values to the maximum values of any entry on that field in predefine time frame. The 472 controller filter natural jiggling value cause by weather as winds, rain, slam doors and alike. This time field table is the base for the controller 472 auto learning algorithm. The auto learning algorithm filters out false triggering, and automatically adjust the detection level to generate the 490 wake_int signal.

The tag main controller 472 is able to move by itself to low current consumption by change state to sleep mode. That happen automatically when the tag finishes reporting the smart phone. Only the wake signal input wake it to active mode.

The tag main controller 472 configures the real time clock 440 DS1337 over I2C to generate an 490 wake_int periodically to let The 472 tag main controller 440 test the battery voltage level and send a keep alive message.

Wake_int 490 signal is generated by Mma7660 400 and by DS1337 440 connected to point 470. Point 470 is transistor gate 476 and it switches on the power from the inner battery 474 to 3V tag bus line. 3V bus line power all parts in the tag. wake_int 490 signal connected to the tag main controller 472 wake 491 pin, which moves the controller from is sleep mode to active mode.

The tag main controller 472 has the inner capability to RF wirelessly transmit and receive the signal to the smart phone using the antenna 482.

The tag main controller 472 utilizes the connector 450 to sense external sensor on I2C bus 480 and on UART bus 478.

The tag connector 450 shows all connection to exterior of the tag. It also exposes pin 5V to get external optional power source to power the tag Voltage regulate chip 495, part number L78L33ABUTR, gets the external 5V power supply and feeds the 3V tag power bus. This is only an option where no battery is required.

The tag has a remote infrared temperature sensing chip 430, part number tmp006. This chip can detect any nearby human body temperature. It is located on the PCB rear side of the tag, facing outside of the attached windows. The 430 temperature sensing chip is programed by controllers 472, over I2C, to generate a wake_int 490 signal on jiggle level on its infrared temperature sensing. It uses the same method of table with index time described already.

The tag has a button 461 figure1 51. It is a tact switch. The user can select mode of operation by pressing it. The pattern on long and short time press defines the command to the tag main controller 472.

The button 465 figure1 50. It is the tag on/off switch. Since the controller 472 move itself to sleep automatically, this button 465 is the button wake-up tag by sending wake_int 490 signal when pressed.

The tag buzzer 420, its sound when 472 controller activates it. The activation is per smart phone apps command or self-activation where there is no smart phone wireless link.

The tag flash memory 410 is the controller 472 memory storage. It stores the controller 472 main application and all data and setting of the tag. Flash memory 410 powers itself from controller 472 PIO2. When the controller 472 is in a sleep mode, the PIO2 is low, and there is no power wasted on power feed to the flash memory 410.

FIG. 14 showing flow chart 600 of jiggle alarm tag detection mechanism and the link to user's smart phone apps and auto calibration its trigger level. Flow chart 600 includes stages 610, 620, 630, 640, 650, 660 and 670.

Figure 15:
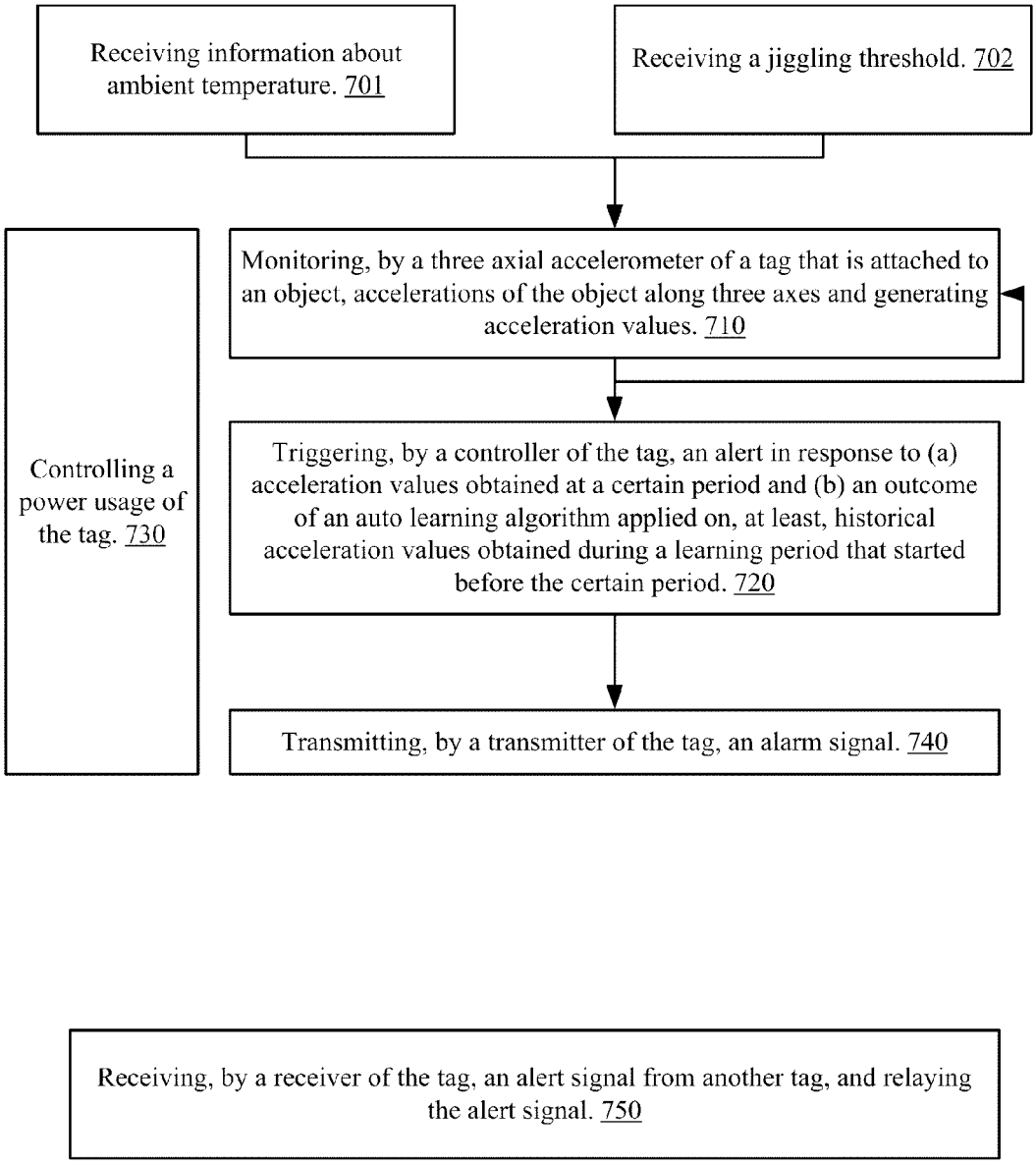
FIG. 15 illustrates a method according to one embodiment of the present invention.

FIGS. 15 and 16 illustrate method 700 according to an embodiment of the invention.

Method 700 may start by stage 710 of monitoring, by a three axial accelerometer of a tag that is attached to an object, accelerations of the object along three axes and generating acceleration values.

Stage 710 may include determining (711) at least one jiggling value that represents differences between acceleration values that (a) are obtained during the certain period and (b) are associated with at least one axis of the three axes. Each jiggling value may represent a maximal difference between acceleration values associated with a certain axis of the three axes.

Stage 710 may include providing (712) an outcome of the auto learning algorithm that may include the jiggling threshold.

Stage 710 may include monitoring (713), by a real time clock mechanism of the tag, a time of occurrence of events.

Stage 710 may be followed by stage 720 of triggering, by a controller of the tag, an alert in response to (a) acceleration values obtained at a certain period and (b) an outcome of an auto learning algorithm applied on, at least, historical acceleration values obtained during a learning period that started before the certain period.

Stage 720 may include applying (721) the auto-learning algorithm to detect acceleration values that deviate from an allowable acceleration pattern. The allowable acceleration pattern may include an allowable change of acceleration values over time.

Stage 720 may include rejecting (722) acceleration values indicative of a jiggling of the object due to weather and to trigger the alert in response to acceleration values that are indicative of an opening of the object.

Stage 720 may include triggering (723) the alert when sensing that at least a portion of the object has undergone a free fall.

The tag further may include a temperature sensor. Stage 720 may include triggering (724) the alert also in response to temperature readings from the temperature sensor.

Stage 720 may be preceded by stage 701 of receiving information about ambient temperature. Stage 720 may include determining (725) whether to trigger the alert in response to the information about the ambient temperature.

Stage 720 may include generating (726) the alert if a jiggling value of the at least one jiggling values exceeds a jiggling threshold. Method 700 may include stage 702 of receiving the jiggling threshold.

Stage 720 may include preventing (727) a triggering of the alert when sensing that a mobile device that is paired to the tag is in proximity of the tag. The tag may include a bar code, QR code, or other graphical code, that facilitates a downloading, by a computerized device, of an application that once executed by the computerized device causes the computerized device to communicate with the tag and to respond to the alert.

Stage 720 may include triggering (728) a buzzer of the tag to output an audio alert.

Method 700 may include stage 730 of controlling a power usage of the tag. Stage 730 may be executed in parallel to stages 710 and 720, before or after these stages.

Stage 730 may include triggering (731) a provision of power to the transmitter in response to the acceleration values that were obtained at a certain period and in response to the outcome of the auto learning algorithm.

Stage 730 may include stopping (732) the provision of the power to the transmitter after at least one out of (a) a lapse of a predefined period after the triggering of the provision of the power, and (b) a completion of a transmission, by the transmitter, of an alert signal to a mobile device paired with the tag.

Stage 720 may be followed by stage 740 of transmitting, by a transmitter of the tag, an alarm signal. The alarm signal may be transmitted over a short range link and be received by an communication device such as a wireless mobile device, a fixed wireless communication device and the like. The alarm signal may be received directly by a device of a user (such as a computer or a mobile phone) that may host an alarm application or code. The alarm signal may reach the device of the user after passing through one or more networks. The user may receive an alarm regardless of the user location—even when the user is abroad.

Stage 740 may include transmitting (741) information about the acceleration values obtained during the certain period. The information about the acceleration values may include at least one jiggling value that represents differences between acceleration values that (a) are obtained during the certain period and (b) are associated with at least one axis of the three axes.

Stage 740 may include generating (742) an audio and/or visual alarm by the tag.

Method 700 may include stage 750 of receiving, by a receiver of the tag, an alert signal from another tag, and relaying the alert signal.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures may be implemented which achieve the same functionality.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A tag that comprises a three axial accelerometer, a controller, a transmitter and an attachment member for attaching the tag to an object;

wherein the three axial accelerometer is configured to monitor accelerations of the object along three axes and generate acceleration values;

wherein the controller is configured trigger an alert in response to (a) acceleration values obtained at a certain period and (b) an outcome of an auto learning algorithm applied on, at least, historical acceleration values obtained during a learning period that started before the certain period;

wherein the controller is configured to determine at least one jiggling value that represents differences between acceleration values that (a) are obtained during the certain period and (b) are associated with at least one axis of the three axes;

wherein each jiggling value represent a maximal difference between acceleration values associated with a certain axis of the three axes.

2. The tag according to claim 1 wherein the controller is configured to apply the auto-learning algorithm to detect acceleration values that deviate from an allowable acceleration pattern.

3. The tag according to claim 2 wherein the allowable acceleration pattern comprises an allowable change of acceleration values over time.

4. The tag according to claim 1 wherein the controller is configured to reject acceleration values indicative of a jiggling of the object due to weather and to trigger the alert in response to acceleration values that are indicative of an opening of the object.

5. The tag according to claim 1 wherein the controller is configured to trigger the alert when sensing that at least a portion of the object has undergone a free fall.

6. The tag according to claim 1 further comprising a temperature sensor; wherein the controller is configured trigger the alert also in response to a temperature reading from the temperature sensor.

7. The tag according to claim 6 wherein the controller is configured to receive information about ambient temperature and wherein the controller is configured to determine whether to trigger the alert in response to the information about the ambient temperature.

8. The tag according to claim 1 wherein the controller is configured to trigger a provision of power to the transmitter in response to the acceleration values that were obtained at a certain period and in response to the outcome of the auto learning algorithm.

9. The tag according to claim 8 wherein the controller is configured to stop the provision of the power to the transmitter after at least one out of (a) a lapse of a predefined period after the triggering of the provision of the power, and (b) a completion of a transmission, by the transmitter, of an alert signal to a mobile device paired with the tag.

10. The tag according to claim 1 wherein the controller is configured to generate the alert if a jiggling value of the at least one jiggling values exceeds a jiggling threshold.

11. The tag according to claim 10 wherein the tag is configured to receive the jiggling threshold.

12. The tag according to claim 10 wherein the outcome of the auto learning algorithm comprises the jiggling threshold.

13. The tag according to claim 1 wherein the controller is configured to prevent a triggering of the alert when sensing that a mobile device that is paired to the tag is in proximity of the tag.

14. The tag according to claim 1 wherein the tag comprises a bar code, QR code, or other graphical code, that facilitates a downloading, by a computerized device, of an application that once executed by the computerized device causes the computerized device to communicate with the tag and to respond to the alert.

15. The tag according to claim 1 wherein the tag comprises a buzzer; wherein the controller is configured to trigger the buzzer to output an audio alert.

16. The tag according to claim 1 wherein the tag comprises a real time clock mechanism, wherein the tag is configured to monitor a time of occurrence of events.

17. The tag according to claim 1 wherein the transmitter is configured, in response to a triggering of the alarm, transmit information about the acceleration values obtained during the certain period.

18. The tag according to claim 17 wherein the information about the acceleration values comprises at least one jiggling value that represents differences between acceleration values that (a) are obtained during the certain period and (b) are associated with at least one axis of the three axes.

19. The tag according to claim 1 wherein the tag comprises a receiver, wherein the receiver is configured to receive an alert signal from another, and wherein the tag is configured to relay the alert signal.

20. A method, comprising:

monitoring, by a three axial accelerometer of a tag that is attached to an object, accelerations of the object along three axes and generating acceleration values;

determining, by a controller of the tag, at least one jiggling value that represents differences between acceleration values that (a) are obtained during the certain period and (b) are associated with at least one axis of the three axes;

wherein each jiggling value represent a maximal difference between acceleration values associated with a certain axis of the three axes; and triggering, by the controller of the tag, an alert in response to (a) acceleration values obtained at a certain period and (b) an outcome of an auto learning algorithm applied on, at least, historical acceleration values obtained during a learning period that started before the certain period.

* * * * *